United States Patent [19]

Malina et al.

[11] Patent Number: 4,635,436

[45] Date of Patent: Jan. 13, 1987

[54] SPINNING DEVICE FOR OPEN-END SPINNING CONTAINING EASILY REPLACEABLE NOZZLE BODY

[75] Inventors: Ludek Malina, Kloten; Ernst Ott, Flurlingen, both of Switzerland

[73] Assignee: Rieter Machine Works Limited, Winterthur, Switzerland

[21] Appl. No.: 854,088

[22] Filed: Apr. 21, 1986

[30] Foreign Application Priority Data

Apr. 29, 1985 [CH] Switzerland ..... 01815/85

[51] Int. Cl.[4] ..... D01H 1/135; D01H 7/885

[52] U.S. Cl. ..... 57/417; 57/414; 57/415

[58] Field of Search ..... 57/400, 404, 414–417, 57/352

[56] References Cited

U.S. PATENT DOCUMENTS

| | | | |
|---|---|---|---|
| 3,328,949 | 7/1967 | Pavek et al. | 57/417 X |
| 3,481,128 | 12/1969 | Landwehrkamp et al. | 57/417 |
| 3,789,597 | 2/1974 | Schon | 57/417 |
| 4,166,354 | 9/1979 | Duba | 57/417 |
| 4,458,477 | 7/1984 | Raasch et al. | 57/415 |
| 4,499,719 | 2/1985 | Faessler | 57/417 |

FOREIGN PATENT DOCUMENTS

| | | |
|---|---|---|
| 788245 | 12/1972 | Belgium . |
| 2065428 | 11/1973 | Fed. Rep. of Germany . |
| 2421672 | 11/1975 | Fed. Rep. of Germany . |
| 2538258 | 3/1977 | Fed. Rep. of Germany . |
| 2097173 | 3/1972 | France . |
| 2339006 | 8/1977 | France . |
| 496115 | 10/1970 | Switzerland . |

*Primary Examiner*—John Petrakes

*Attorney, Agent, or Firm*—Werner W. Kleeman

[57] ABSTRACT

The spinning device for open-end spinning comprises a withdrawal nozzle secured to a cover of a rotor housing for a spinning rotor and a nozzle body coacting with the withdrawal nozzle. The withdrawal nozzle and the nozzle body conjointly form a withdrawal passage or channel for the thread or the like produced by the spinning rotor. The cover is provided with a receiving socket which fixes the position of the nozzle body in radial direction, the nozzle body being inserted into the receiving socket. The nozzle body is pressed against the withdrawal nozzle by means of a manually-operable elastic device. The formation of the receiving socket permits insertion and removal of the nozzle body from the front side, that is from the service side of the spinning device. This provides the advantage of ready accessibility of the nozzle body and, in turn, thus affords easy replacement thereof. Replacement can be carried out without the use of tools. This also has the significant advantage of elimination of the risk of damage or scratching of the spinning device, which risk otherwise is present whenever tools are used.

6 Claims, 2 Drawing Figures

12
13
14
15
16
16a
17
18
18a
18b
18c
19
20
21
22
23
23a
23b
24
25
26
27
28
29
30
31
31a
32
33
34
35
35a
36
37
II

SPINNING DEVICE FOR OPEN-END SPINNING CONTAINING EASILY REPLACEABLE NOZZLE BODY

BACKGROUND OF THE INVENTION

The present invention relates to a new and improved construction of a spinning device for open-end spinning.

Generally speaking the spinning device for open-end spinning according to the present invention is of the type comprising a spinning rotor for forming a thread or the like and located in a rotor housing. There is further provided a withdrawal nozzle secured to the cover of the rotor housing and a nozzle body. The withdrawal nozzle and the nozzle body adjoin or abut one another and conjointly form a withdrawal passage or channel for the thread or other filamentary material or the like departing from the spinning rotor.

A spinning device of this general type has already been disclosed in Swiss Pat. No. 529,231. In accordance with FIG. 2 of that patent a delivery element is secured by means of a screw, and a limiting element is screwed or threaded onto a front cover. These two parts conjointly form a withdrawal passage or channel for the thread leaving the spinning rotor. For purposes of replacement of these parts, both such parts or components must be inserted into the spinning device from the rear, considered with reference to the service side of the spinning device, and such parts or components must also again be removed from the rear. In spinning devices of the type here under discussion, replacement of these parts or components serves primarily for adaptation of the spinning device to various fiber types, for replacement of a defective part, or for achievement of required yarn characteristics or properties such as, for example, hairiness or twist.

A disadvantage of this known spinning device is that, on the one hand, for replacement of the delivery element or nozzle body, such must be inserted into the spinning device from the rear and withdrawn towards the rear. Accessibility is rendered more difficult due to the need to carry out replacement of the relevant parts or components from the rear. Also, since parts of the known spinning device are screwed together, tools such as screwdrivers, spanners, and so forth must be used during any replacement operation. There is thus present a serious disadvantage that, in the course of a replacement operation, there is a serious risk of damage or scratching of the spinning device by these tools. This risk is additionally increased by virtue of the need to carry out the replacement operation from the rear of the spinning device. Since such spinning devices and their component parts are fabricated with the greatest precision, even a small scratch can produce disadvantageous results.

SUMMARY OF THE INVENTION

Therefore with the foregoing in mind, it is a primary object of the present invention to provide a new and improved construction of a spinning device for open-end spinning which is not afflicted with the aforementioned drawbacks and limitations of the prior art construction discussed above.

Another important and more specific object of the present invention is to provide a new and improved construction of a spinning device for open-end spinning which contains an easily replaceable nozzle body which can be both installed and removed without the need to resort to the use of tools, so that there is obviated or substantially reduced the danger of damaging parts of the spinning device.

Still a further noteworthy object of the present invention aims at providing a new and improved construction of a spinning device for open-end spinning which contains an easily replaceable nozzle body which can be installed and removed from the front or surface side of the spinning device and importantly without requiring the use of tools or other implements, so that there is eliminated or at least appreciably reduced the danger of damaging parts of the spinning device which would impair the quality of the fabricated thread or the like.

Yet another significant object of the present invention is to provide a new and improved construction of a spinning device for open-end spinning which is readily simple in construction and design, highly reliable in operation, not readily subject to breakdown or malfunction, economical to manufacture, and affords ready and reliable replacement of the parts or components forming the thread withdrawal passage or channel, especially the nozzle body but also the withdrawal nozzle, without the need to use tools or the like, and thus, eliminating or appreciably reducing the danger of damage to the spinning device.

Now in order to implement these and still further object of the invention, which will become more readily apparent as the description proceeds the spinning device for open-end spinning of the present development is manifested by the features that a receiving socket is provided at the cover of the rotor housing for enabling movements of the nozzle body which occur in the axial direction thereof. The receiving socket determines or fixes the position of the nozzle body in radial direction and such nozzle body is inserted into the receiving socket. The receiving socket has a form or construction which permits insertion and removal of the nozzle body from the front or surface side of the spinning device. There is also provided a manually-operable elastic or resilient device which engages an end of the nozzle body which is located remote from its position of engagement or abutment with the withdrawal nozzle. This elastic device is biased towards the nozzle body in the axial direction thereof and presses such nozzle body against the withdrawal nozzle.

The invention thus affords the advantage that replacement of the nozzle body can be carried out without the use of tools, thus eliminating the possibility of damage caused by such tools during a replacement operation. A further significant advantage of the present invention is the ability to replace the nozzle body from the front or surface side of the spinning device, so that this replacement operation is additionally simplified.

In accordance with a particular embodiment of the present invention, the withdrawal nozzle is positionally held in place by a quick make-and-release connection, particularly by means of a bayonet or bayonet-type connection. In this embodiment, insertion of the withdrawal nozzle is carried out in such manner that the front end portion of the withdrawal nozzle, which is provided with or supports lateral arms, is inserted from the rear through an opening in the rotor housing cover substantially corresponding in shape or congruent with the cross-section of the withdrawal nozzle and the outline or contour of the arms thereof, and such inserted withdrawal nozzle is thereafter appropriately rotated so that it can be easily fixed in its proper position. Removal of such previously inserted withdrawal device is carried out by accomplishing the same two movements which now are performed, however, in the reverse sequence. It will be readily apparent that these manipulations or operations are very simple to perform. As a result of these very simple manipulations, the replacement of the withdrawal nozzle can be accomplished by performing very simple operations, which again can be carried out without any difficulty, although they are performed from the rear, and which also can be beneficially carried out without the use of tools.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figures 1, 2:
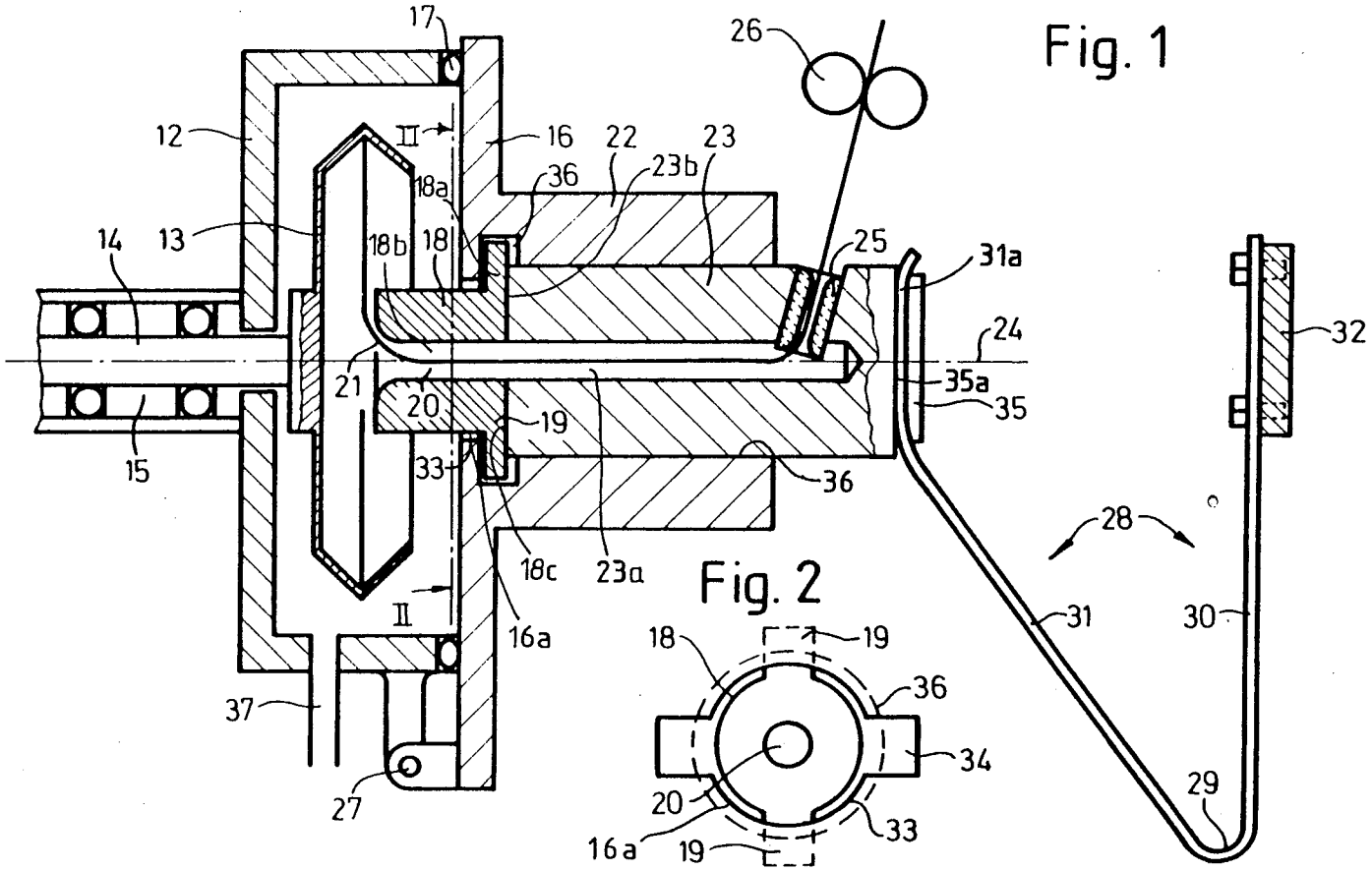
FIG. 1 is a section through a spinning device constructed in accordance with the present invention, viewed from the side.
FIG. 2 is a sectional view taken along the line II—II of FIG. 1 showing certain details of the spinning device.

Describing now the drawings, it is to be understood that only enough of the structure of the spinning device for open-end spinning has been depicted therein as needed for those skilled in the art to readily understand the underlying principles and concepts of the present development while simplifying the illustration of the drawings. Turning attention now to FIG. 1 of the drawings, it will be seen that a rotor housing 12 contains therein a spinning rotor 13 which is rotatably supported by a shaft 14. This shaft 14 is rotatable or rotatably mounted in a rotation bearing 15 or equivalent structure. The rotor housing 12 has a cover or cover member 16. A sealing ring 17 is interposed between the cover 16 and the rotor housing 12. The standard nozzle or the like used for feeding fibers to the spinning rotor 13 has not been shown for reasons of clarity of illustration.

Cover 16 supports a thread withdrawal nozzle 18. This withdrawal nozzle 18 can be screwed into the cover 16. In the illustrated embodiment, however, the withdrawal nozzle 18 is secured to the cover 16 by means of a bayonet-type connection. This quick-operating securing arrangement will be described in greater detail later in this disclosure. The withdrawal nozzle 18 has two radially extending arms or arm members 19 provided at its front end portion **18*a* (see also FIG. 2). Such withdrawal nozzle 18 also possesses a bore portion 18*b* defining part of a withdrawal passage or channel 20 for the thread or yarn 21 or like filamentary material spun by means of the spinning rotor 13**.

Furthermore, a push-fit socket or receiving socket 22 is connected with the cover 16. A nozzle body 23 is supported by the receiving socket 22. Nozzle body 23 contains a bore portion **23*a* likewise defining part of the thread withdrawal passage or channel 20. This nozzle body 23 is movable in its lengthwise or longitudinal direction, that is to say, in its axial direction or the direction of the axis 24 depicted in FIG. 1. Nozzle body 23 constitutes a substantially cylindrical tubular or cylindrical body in the illustrated embodiment. A corresponding receiving opening or bore 36 defining a guide means for the nozzle body 23 is provided in the receiving socket 22. This substantially circular or cylindrical receiving opening or bore 36 forms a precisely fitting receiving opening or bore for the nozzle body 23, but permits movement of the latter in the axial direction 24. As stated previously, the bore portion 23*a* of the nozzle body 23 comprises a portion of the withdrawal passage or channel 20 for the thread 21. A hollow, substantially cylindrical ceramic portion or part 25 is provided at the exit side or outlet of the withdrawal passage or channel 20, as clearly shown in FIG. 1. Among other things, this hollow, substantially cylindrical ceramic portion or part 25 serves to influence the characteristics of the fabricated thread 21. A conventional withdrawal roller pair 26 is provided downstream of such ceramic portion or part 25**.

The cover or cover member 16, together with the withdrawal nozzle 18 and the receiving socket 22, is pivotable about a pivot shaft or axle 27 supported by the rotor housing 12. A tube or pipe 37 serves to produce an underpressure within rotor housing 12.

Finally, an elastic or resilient device 40 is provided in order to exert a suitable pressure or force against the nozzle body 23. In the illustrated example, this elastic or resilient device 40 consists of a substantially band-shaped leaf spring 28 which comprises an approximately U-shaped portion 29 from which extend two legs or leg members 30 and 31. Leg 30 is secured to a stationary wall portion or housing means 32 of the spinning device. The withdrawal nozzle 18 and the nozzle body 23 are positioned so as to be in engagement with or abutting relationship with one another at their respective mutually confronting ends **18*c* and 23*b* by virtue of the pressure exerted by the leg or leg member 31 on the nozzle body 23**.

As already mentioned, the withdrawal nozzle 18 is provided with two arms or arm members 19. These arms or arm members 19 are located at the front end portion **18*a* of the withdrawal nozzle 18 adjacent the location of contact between the mutually confronting ends 18*c* and 23*b* of the withdrawal nozzle 18 and nozzle body 23, respectively. On the other hand, the cover 16 contains an opening 16*a* possessing a substantially cylindrical portion 33 and the cut-out sections or recesses 34, which substantially correspond to or are congruent with the cross-section of the withdrawal nozzle 18 and the outline or contour of the arms or arm members 19. In particular, the substantially circular or cylindrical portion 33 of the opening 16*a* substantially corresponds to or is congruent with the cross-section of the withdrawal nozzle 18, and the cut-out sections or recesses 34 substantially correspond to or are coincident with the outline or contour of the radially extending arms 19. Thus, the front end portion 18*a* of the withdrawal nozzle 18 carrying the arms 19 can be inserted through the opening 16*a* containing the substantially circular or cylindrical portion 33 and the cut-out sections or recesses 34 from the left in accordance with FIG. 1. If the withdrawal nozzle 18 is thereupon rotated, for example through 90°, and released, then as a result of the pressure of the band-shaped leaf spring 28 exerted on the withdrawal nozzle 18 via the nozzle body 23, the radially extending arms 19 supported on the withdrawal nozzle 18 engage the cover 16. The withdrawal nozzle 18 is thus held in the manner of a bayonet connector, and rotation of the withdrawal nozzle 18 cannot arise because of the contact pressure or force exerted by the leaf spring or spring means 28**.

In the illustrated example, the bore 36 of the receiving socket 22 has a substantially cylindrical form and the withdrawal nozzle 18 and bore 36 are disposed in a coaxial arrangement with respect to the axis 24. If, in such an arrangement, the radially extending arms 19 project beyond the bore 36 in the radial direction, then the advantage is obtained that the withdrawal nozzle 18 cannot fall out after removal of the nozzle body 23. Under these circumstances, the arms 19 are held on one side by the rotor housing cover 16 and on the other side by the end 23*b* of the receiving socket 22 depicted at the left in the showing of FIG. 1.

In the illustrated example, the nozzle body 23 has a notch 35 in the region of contact with the elastic device 40, here shown by way of example and not limitation in the form of a leaf spring 28. The free end 31*a* of the leg 31 of spring 28 engages a base surface 35*a* of this notch 35. The width of the notch 35 is equal to the width of the leaf spring 28. This arrangement retains the nozzle body 23 against rotation about its own lengthwise axis, and in this way there is ensured exact rotational positioning of the portion of the withdrawal passage or channel 20 extending through the nozzle body 23 and which is defined by the bore portion 23*a*.

For purposes of insertion or removal of the nozzle body 23, the leaf spring or spring means 28 (that is, the leg 31 thereof) is pressed in the appropriate direction against the bias thereof, that is to the right as viewed in the showing of FIG. 1. This can be performed manually. Thereupon, the nozzle body 23 can be set into the receiving socket 22 or can be removed therefrom.

It is to be understood that other springs or resilient elements can be used instead of the leaf spring 28 formed, for instance, by a band of plastic material. Thus, a helical spring can be used in place of the band-shaped leaf spring 28. In this case, however, the illustrated and previously described simple rotational positioning of the portion of the thread withdrawal passage 20 formed by the nozzle body 23 is not obtained.

To receive the nozzle body 23, the receiving socket 22 can be formed with a trough-shaped receiving opening instead of the circular or round bore 36.

Also, the receiving socket 22 and/or the nozzle body 23 can have, for example, a polygonal section or cross-sectional configuration. For example, the receiving socket 22 can be provided with an opening having a V-shaped cross-section, or a nozzle body can be provided with a prismatic cross-section.

While there are shown and described present preferred embodiments of the invention, it is to be distinctly understood that the invention is not limited thereto, but may be otherwise variously embodied and practiced within the scope of the following claims.

Accordingly, what we claim is:

1. A spinning device for open-end spinning for forming a thread or the like, comprising:

a rotor housing;

a cover provided for said rotor housing;

a spinning rotor located in said rotor housing and serving for forming a thread which is withdrawn from the spinning rotor;

a withdrawal nozzle secured to the cover of the rotor housing;

a nozzle body having an axial direction and coacting with said withdrawal nozzle;

said withdrawal nozzle and said nozzle body abuttingly contacting one another and conjointly forming a withdrawal passage for the thread withdrawn from the spinning rotor;

a receiving socket provided at said cover for insertably receiving therein said nozzle body and enabling movements of said nozzle body in said axial direction of said nozzle body;

said receiving socket determining the position of said nozzle body in radial direction;

said receiving socket being structured to permit insertion and removal of the nozzle body from a front side of the spinning device;

a manually-operable elastic device engaging an end of said nozzle body remote from an end of said nozzle body which abuttingly contacts said withdrawal nozzle; and said manually-operable elastic device being biased towards said nozzle body in the axial direction thereof and pressing said nozzle body against said withdrawal nozzle.

2. The spinning device as defined in 1, wherein:

said withdrawal nozzle defines a substantially cylindrically-shaped withdrawal nozzle having a lengthwise axis;

said substantially cylindrically-shaped withdrawal nozzle having arms extending in radial direction of said substantially cylindrically-shaped withdrawal nozzle;

said arms of said substantially cylindrically-shaped withdrawal nozzle being supported at a front end portion of said withdrawal nozzle adjacent the location of abutting contact of said withdrawal nozzle with said nozzle body;

said cover being provided with an opening which substantially corresponds in shape to the cross-section of the substantially cylindrically-shaped withdrawal nozzle and the contour of the arms, so that after insertion of said front end portion of said substantially cylindrically-shaped withdrawal nozzle supporting said arms through said opening and rotation of said substantially cylindrically-shaped withdrawal nozzle about said lengthwise axis thereof, said arms are pressed against said cover by said nozzle body which is biased by said elastic device, and the withdrawal nozzle is held in said cover in the manner of a bayonet connection.

3. The spinning device as defined in 1, wherein:

said receiving socket contains a substantially cylindrical bore which forms a guide for said nozzle body inserted therein;

said nozzle body defining a substantially cylindrical nozzle body;

said elastic device being formed as a substantially band-shaped leaf spring contacting said nozzle body at a predetermined region thereof at said end of said nozzle body which is located remote from said end which abuttingly contacts said withdrawal nozzle;

said nozzle body being provided with a notch in said predetermined region of contact with said leaf spring;

said notch having a predetermined disposition with reference to a portion of the withdrawal passage formed by the nozzle body;

said notch possessing a base surface and a width which is substantially equal to the width of said substantially band-shaped leaf spring; and said substantially band-shaped leaf spring engaging said base surface of said notch.

4. The spinning device as defined in claim 3, wherein:

said withdrawal nozzle is arranged substantially coaxially with respect to said substantially cylindrical bore of said receiving socket; and said withdrawal nozzle possessing arms projecting beyond said substantially cylindrical bore in said radial direction.

5. The spinning device as defined in 3, wherein:

said substantially band-shaped leaf spring is formed by a band of elastic material which has an approximately U-shaped portion and two legs extending away from said U-shaped portion; and one of said legs being capable of being secured at one end thereof to a housing of the spinning device and the other said leg engaging with an end portion thereof at the nozzle body at said predetermined region thereof and being manually-operable.

6. A spinning device for open-end spinning for forming a thread or the like, comprising:

a rotor housing;

a cover provided for said rotor housing;

a spinning rotor located in said rotor housing for forming a thread which is withdrawn from the spinning rotor;

a withdrawal nozzle releasably secured to the cover of the rotor housing;

said withdrawal nozzle containing a bore portion;

a nozzle body having an axial direction and coacting with said withdrawal nozzle;

said nozzle body containing a bore portion;

said withdrawal nozzle and said nozzle body having mutually confronting ends;

said withdrawal nozzle and said nozzle body abuttingly contacting one another at said mutually confronting ends and conjointly forming by means of said bore portions of said withdrawal nozzle and said nozzle body a withdrawal passage for the thread withdrawn from the spinning rotor;

a receiving socket supported by said cover for insertably receiving therein said nozzle body and enabling movements of said nozzle body in said axial direction of said nozzle body;

said receiving socket fixing the position of said nozzle body in radial direction;

said receiving socket possessing guide means for said nozzle body in order to permit insertion and removal of said nozzle body from a front side of the spinning device;

a manually-operable elastic device engaging an end of said nozzle body remote from said end of said nozzle body which confronts said end of said withdrawal nozzle; and said manually-operable elastic device being biased towards said nozzle body in the axial direction thereof and pressing said nozzle body against said withdrawal nozzle.

* * * * *